US005931292A

United States Patent [19]

Focke et al.

[11] Patent Number: 5,931,292

[45] Date of Patent: Aug. 3, 1999

[54] PACKET FOR TOBACCO GOODS, ESPECIALLY CIGARETTES, AS WELL AS METHOD AND DEVICE FOR MANUFACTURING SAME

[75] Inventors: Heinz Focke, Verden, Germany; Herman Roesink, Abcoude, Netherlands

[73] Assignee: Focke & Co. (GmbH & Co.), Verden, Germany

[21] Appl. No.: 08/843,773

[22] Filed: Apr. 22, 1997

[30] Foreign Application Priority Data

Apr. 26, 1996 [DE] Germany ..... 196 16 871

[51] Int. Cl.[6] ..... B65D 85/10

[52] U.S. Cl. ..... 206/264; 206/273; 206/459.5

[58] Field of Search ..... 206/242, 247, 206/265, 267, 268, 271, 273, 459.5

[56] References Cited

U.S. PATENT DOCUMENTS

| | | | |
|---|---|---|---|
| 3,809,227 | 5/1974 | Begemann | 206/264 |
| 4,718,216 | 1/1988 | Focke et al. . | |
| 5,035,935 | 7/1991 | Thomas et al. . | |

FOREIGN PATENT DOCUMENTS

| | | |
|---|---|---|
| 601411 | 6/1994 | European Pat. Off. . |
| 260605 | 8/1911 | Germany . |
| 939977 | 3/1956 | Germany . |
| 6934274 | 9/1969 | Germany . |
| 3022525 | 1/1981 | Germany . |
| 2510094 | 8/1986 | Germany . |
| 3639644 | 5/1988 | Germany . |
| 4027247 | 8/1991 | Germany . |

*Primary Examiner*—Jim Foster

*Attorney, Agent, or Firm*—Sughrue, Mion, Zinn, Macpeak & Seas, PLLC

[57] ABSTRACT

Packet for tobacco goods, especially cigarettes, as well as method and device for manufacturing same. Cigarette packets (10) are generally provided with an outer wrapping (11) made of a transparent film. Furthermore, cigarette packets (10) must have a revenue stamp (24). The latter is applied to the inner side of the outer wrapping (11), namely connected to same in such a way that the top surface of the revenue stamp (24) faces outwards. The revenue stamp (24) is expediently applied in such a way that it is split in two when a tear strip (22) of the outer wrapping (11) is used.

4 Claims, 3 Drawing Sheets

Figure 2:
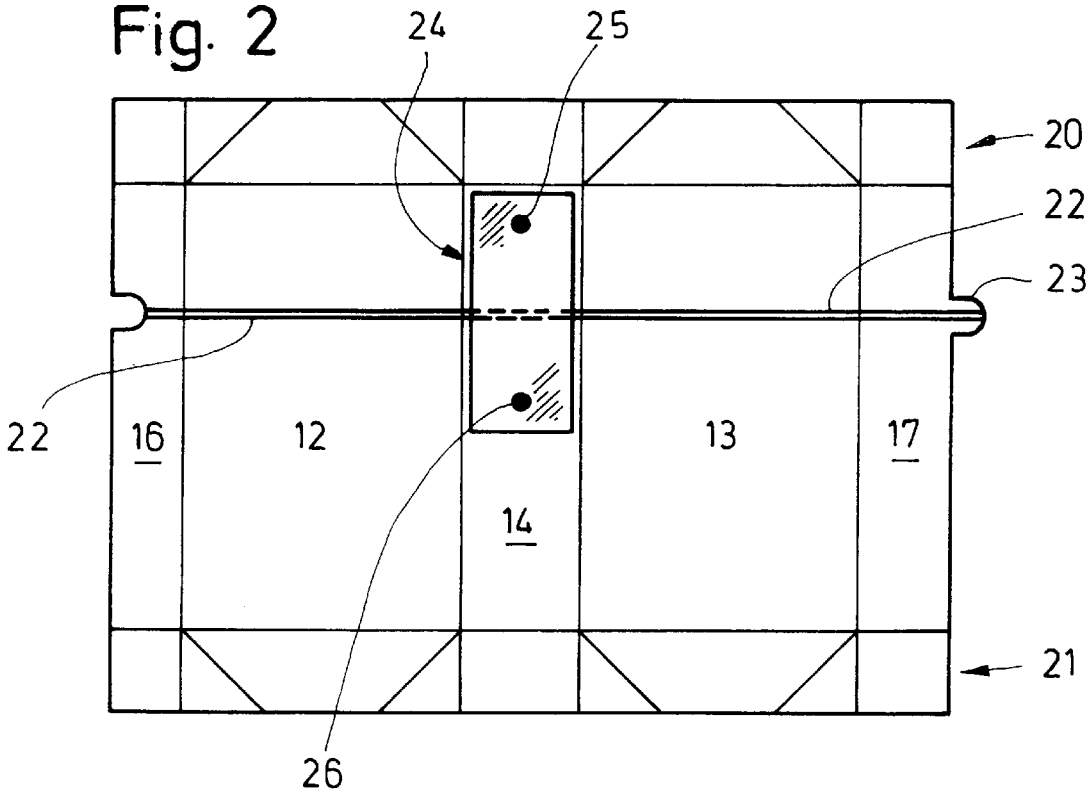

PACKET FOR TOBACCO GOODS, ESPECIALLY CIGARETTES, AS WELL AS METHOD AND DEVICE FOR MANUFACTURING SAME

SPECIFICATION

The invention relates to a packet for tobacco goods, especially a cigarette packet, with a revenue stamp consisting of a separate (paper) blank on the outside and with an outer wrapping made of transparent film and surrounding the packet. In addition, the invention relates to a method and device for manufacturing packets of this type.

It is internationally customary to provide packets for tobacco goods, especially cigarette packets, with a revenue stamp which marks the packet as being "taxed" in the sense of legal regulations. The revenue stamp is a label made of paper or similar material and printed on one side. Application of the revenue stamp to the packet depends on the design structure of the packet. Thus, on so-called "soft-case packets", it is usual for the revenue stamp to be folded in a U-shape over an upper end surface and adjoining front and back sides of the packet. On cigarette packets of the hinge-lid type, the revenue stamp is generally positioned in such a way that a cover of this type of box is held in a closed position and the stamp is completely or partially split when the lid is opened. The packet provided with the revenue stamp is generally surrounded by an outer wrapping which consists of transparent material, namely cellulose film or a polymer film. The application of the revenue stamp on packets of this sort is a particular problem in packaging technology since in the complex folding processes a special application step, and if necessary folding step, must be inserted. Moreover, the packet itself becomes unattractive because of the remains of the revenue stamp adhering to the packet after it has been opened.

The purpose underlying the invention is to propose a packet for cigarettes and other taxable products, in which the manufacturing process of applying the revenue stamp or some other distinguishing mark is simplified and the appearance of the packet is improved.

In fulfillment of this purpose the packet according to the invention is characterised in that the revenue stamp is fixed to the inner side of the transparent outer wrapping with its printed side facing outwards.

In the design of the packet according to the invention, the revenue stamp is accordingly no longer attached to the actual packet made of (thin) cardboard, paper or the like but to the outer wrapping made of cellulose film or plastic film. The revenue stamp is here arranged on the inside. The presence of the revenue stamp can therefore be established in the same way as on traditional packets. The revenue stamp can only—likewise as on previously usual packets—be removed by opening, i.e. by removing the outer wrapping.

According to the invention there are different possible solutions for applying the revenue stamp to the outer wrapping of the packet. Positioning the revenue stamp in the region of the kind of tear thread or strip for the outer wrapping as is usual on packets of this type is particularly advantageous. The tear strip is here positioned in such a way that the revenue stamp is divided in two and thus defaced when the packet is opened by pulling the tear strip. This effect is prescribed by law in many countries.

The application, according to the invention, of the revenue stamp to the outer wrapping of the packet is also advantageous. Blanks for the outer wrapping are separated from a continuous sheet of the packaging material. According to the invention, the revenue stamp is placed on the sheet of material for the outer wrapping in an appropriate position. The tear strip is then applied to the same side which corresponds to the inner side of the subsequent packaging.

The device according to the invention for manufacturing packets of this type or for the preparation of the sheet of material and blanks for the outer wrapping requires only simple modifications in relation to traditional machines. Thus, according to the invention a gluing assembly is provided by means of which glue spots (of clear glue) are applied in the appropriate position on the inner side of the sheet of material and subsequently blanks for the revenue stamp are taken from a magazine and applied to the glue spots. The sheet of material is thus prepared for further processing in respect of the revenue stamp.

Figure 1:
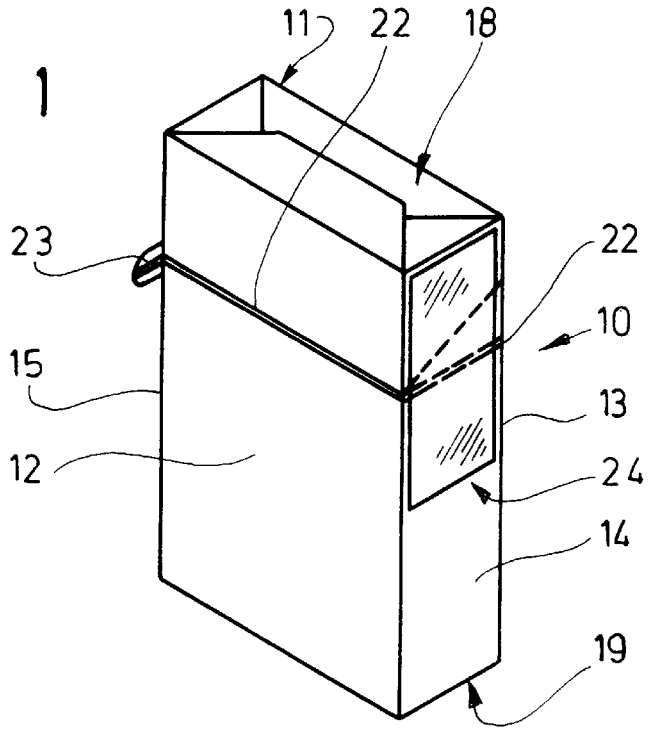
Figure 3:
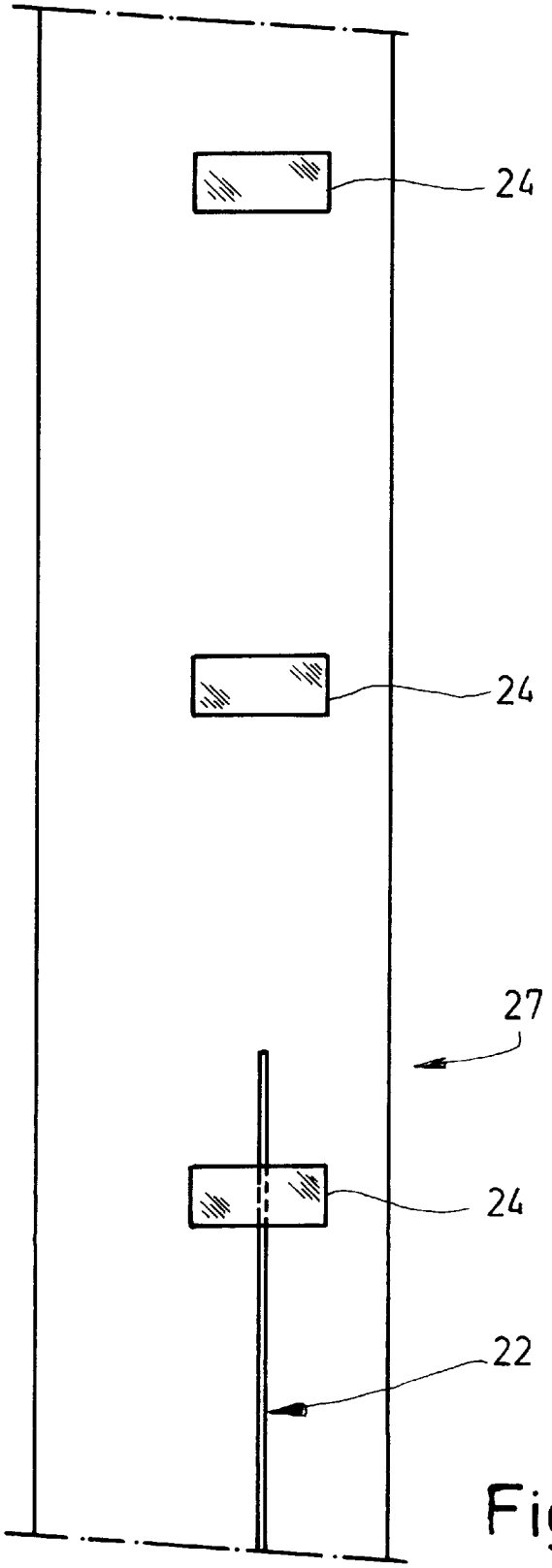
Figure 4:
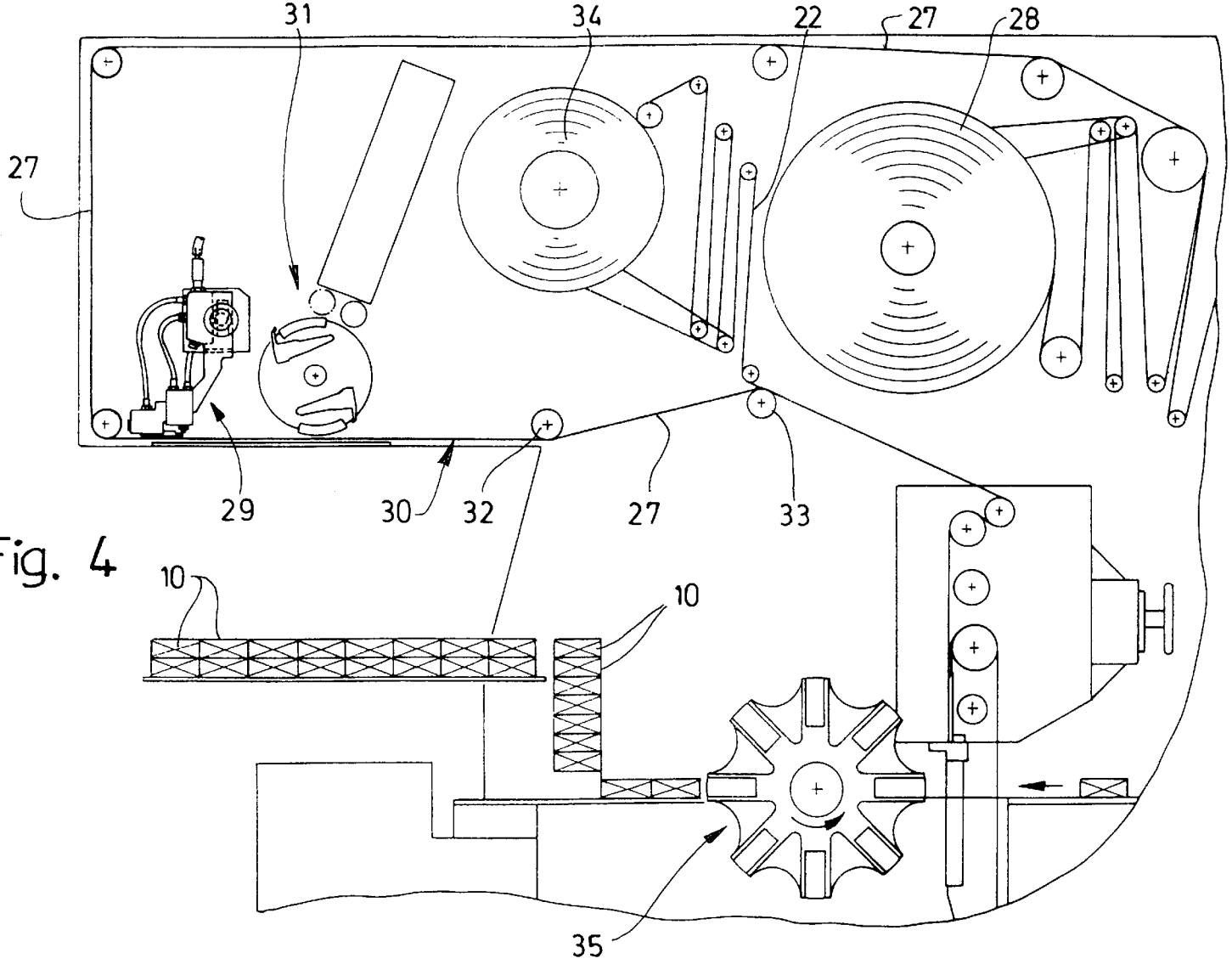

Further details of the invention are the subject-matter of the patent claims and are explained in more detail below with the aid of the embodiments, given by way of example and shown in the drawings. These show:

FIG. 1 a cigarette packet in perspective,

FIG. 2 a blank for an outer wrapping,

FIG. 3 a section of a sheet of material during preparation for the production of packets, FIG. 4 a part of a packaging machine for packets in accordance with FIG. 1, in simplified side view.

The design of cuboid-shaped cigarette packets 10 is shown in the drawings as an embodiment, given by way of example. The packets are designed as cuboid-shaped.

On most types of cigarette packets 10, especially on hinge-lid packets and soft-case packets, the actual packet made of paper, cardboard or the like is surrounded by an outer wrapping 11. The latter completely encloses the actual packet. When the packet is used the outer wrapping 11 is removed.

The outer wrapping 11 consists of transparent or clear packaging material, namely of thin cellulose or plastic films. FIG. 2 shows a blank for an outer wrapping 11 of this type. The example is designed in such a way that the cuboid-shaped packet is wrapped according to the principle of cross-wrapping. The blank according to FIG. 2 accordingly comprises front wall 12, back wall 13, side walls 14 and 15. The latter are formed by two wall flaps 16 and 17 which partially cover one another and are in each case formed at the edge of the blank. When the outer wrapping 11 is folded into its final position, the inner wall flap 16 is covered by the outer wall flap 17 and connected to same.

An upper end wall 18 and a base wall 19 of the outer wrapping 11 consist of folding flaps which partially cover one another and are interconnected. Folding strips 20, 21 at the edge of the substantially rectangular blank for the outer wrapping 11 form these folding flaps. The envelope-style folding principle for the end wall 18 and the base wall 19 is known and usual.

The outer wrapping 11 formed in this way encloses the packet completely, on all sides and seals it to a large extent. To open the outer wrapping 11 when the cigarette packet 10 is used, the outer wrapping 11 is provided with a tear strip 22. This strip extends all around in the upper region of the cigarette packet 10 or the outer wrapping 11. It can be grasped and pulled off with a tab 23 on an external end of the tear strip 22. As this happens, the film of the outer wrapping 11 is split in the region of the tear strip 22. When the tear strip 22 runs right round, an upper portion of the outer wrapping 11 is separated off. This portion can be removed from the packet like a cap. The tear strip 22 is connected to the film of the outer wrapping 11 by sealing or gluing, especially on the inner side of the outer wrapping 11.

A characteristic feature of the present cigarette packet 10 consists in the fact that a revenue stamp 24, such as is usual on this type of packet and similar packets, is applied to the outer wrapping 11 and not—as previously—to the actual packet. The revenue stamp 24 is fastened to the inner side of the outer wrapping 11 in such a way that the top surface of the revenue stamp 24, i.e. what is printed on it, faces outwards. The transparent outer wrapping 11 makes the revenue stamp 24 absolutely visible.

The revenue stamp 24 can be fastened in different ways to the inner side of the outer wrapping 11. In the present case (two) glue spots 25, 26 are provided for this purpose. These are arranged at a distance one from the other. The glue spots 25, 26 consist expediently of a transparent glue which is applied thinly and therefore cannot be noticed from outside, or hardly so. The tear strip 22 is here positioned in such a way that it runs between the two glue spots 25, 26, with the result that the revenue stamp 24 is fixed on both sides of the tear strip 22.

The revenue stamp 24 can assume any appropriate geometrical shape and also be applied to different points of the outer wrapping 11. Thus it is possible, with corresponding dimensions and design of the revenue stamp 24, to apply said stamp in the region of a plurality of walls of the outer wrapping 11, for example in the region of the side wall 14 and in partial regions of the adjoining front wall 12 and/or back wall 13. The revenue stamp 24 can here be folded in a U-shape or in an angular shape inside the finished cigarette packet 10.

However, the embodiment, given by way of example and shown in the drawings, is particularly advantageous in respect of the application of the revenue stamp 24. Here the revenue stamp 24 extends exclusively in the region of the closed side wall 14. The rectangular revenue stamp 24 is slightly narrower than the side wall 14 and significantly shorter. The revenue stamp 24 is disposed in the upper region of the side wall 14 to below the end wall 18.

What is particularly important is the cooperation of the revenue stamp 24 with the tear strip 22. The latter extends in the region of the revenue stamp 24. The result of this is that, when the outer wrapping 11 is opened with the aid of the tear strip 22, the revenue stamp is cut in two by the tear strip 22. The revenue stamp 24 is thereby "cancelled". In the present case, the relative position of the tear strip 22 and the revenue stamp 24 is such that the latter runs approximately centrally across the surface of the revenue stamp 24 and thereby divides it approximately in the centre.

The revenue stamp 24 can be applied in a technically simple fashion to the outer wrapping 11. The blank of same is separated from a continuous sheet of material 27, i.e. a sheet of film, resulting in blanks as in FIG. 2. The tear strip 22 is applied to the sheet of material 27 in an appropriate position. The tear strip can be continuously connected to the sheet of material 27 by sealing with hot-melt adhesives or with the aid of a permanent glue. The revenue stamps 24 are likewise fixed on the sheet of material in an appropriate position, namely taking into account the severance cuts for producing the blanks according to FIG. 2. FIG. 3 shows the sheet of material 27 in front elevation, i.e. the side facing outwards on the outer wrapping 11. The revenue stamps 24 are applied on the reverse side, i.e. inside. The tear strip 22 is applied thereafter, in such a way that it lies on the inside in the region of the revenue stamp 24, covering the inner side of the revenue stamp. This guarantees that the revenue stamp 24 is split in two during the tearing open process.

The device can in principle be constructed as shown in FIG. 4. The sheet of material 27 is led from a reel 28. The material then reaches the region of a gluing assembly 29 via deflection rollers. The necessary gluing points or spots 25, 26 are applied by the gluing assembly via nozzles to the inner side of the material 27 facing upwards, in appropriate positions. To this end, the sheet of material 27 forms, in the region of the gluing assembly 29, a section 30 led horizontally. The gluing assembly 29 is preferably designed in the manner described in EP 0 601 411. Directly following the gluing assembly 29, the revenue stamps 24 are laid on to the not yet set glue spots. A revenue stamp assembly 24 is used for this purpose. It lays on the revenue stamps 24 in the region of the glue spots 25, 26, as the sheet of material 27 is continuously conveyed. The revenue stamp assembly 31 can be configured in the sense of EP 0 444 547. However, a revenue stamp assembly on which the stamps are separated one after the other from a continuous sheet may also be used.

The sheet of material 27 provided with the tear strip 22 is led via a pressure roller 32 which adjoins the inner side of the material 27, and the revenue stamps 24 are in each case pressed additionally on to the material in order to stabilize the connection.

The sheet of material 27 then reaches the region of a deflection roller 33. In this region, the tear strip 22 is laid on to the sheet of material 27 as it is continuously conveyed, and connected to same. The tear strip 22 is here drawn from a reel 34.

The sheet of material 27 which has now been prepared for the packet is conveyed into the region of a folding station 35. Here the packets are led in and packed in the outer wrapping 11 in the region of a rotary folding device 35. The cigarette packets 10 emerging from this device are ready for distribution.

Instead of revenue stamps, other banderoles, labels, notices, vouchers etc. may be positioned in the manner described inside packaging so as to be visible.

We claim:

1. A cigarette pack, with a cuboid-shaped pack container (10) made of paper or thin cardboard for receiving the pack contents and with an outer wrapping (11) made of transparent film, the cigarette pack further comprising:

a carrier of printed matter (24) made from a blank and arranged between the pack container (10) and outer wrapping (11), the carrier of printed matter (24) being arranged so that its printed side faces the outer wrapping (11), wherein the carrier of printed matter (24) is connected to the outer wrapping (11) by glue (25, 26), and the carrier of printed matter (24) is disposed adjacent a narrow, upright first side wall (14) of the outer wrapping (11), the first side wall (14) is arranged between a front wall (12) and back wall (13) and opposite a second side wall formed from wall flaps (16, 17).

2. A pack according to claim 1, wherein:

the carrier of printed matter (24) is a one-layer, rectangular blank made of paper;

the width of the carrier of printed matter (24) is less that the width of the first side wall (14); and the height of the carrier of printed matter 24 is less than the height of the first side wall (14).

3. A cigarette pack, with a cuboid-shaped pack container (10) made of paper or thin cardboard for receiving the pack contents and with an outer wrapper (11) made of transparent film, the cigarette pack further comprising:

a revenue stamp (24) made of paper, the revenue stamp (24) being connected to the inner side of the outer wrapping (11), by glue, wherein a printed side of the revenue stamp (24) faces the outer wrapping (11), and a tear strip (22) on the outer wrapper (11), the revenue stamp (24) being located adjacent the tear strip 22, wherein the tear strip (22) is connected to the inner side of the outer wrapper, the tear strip (22) adjoining the inner side of the revenue stamp (24) in such a way that the revenue stamp is split when the outer wrapping (11) is opened with the aid of the tear strip (22).

4. A pack according to claim 3, wherein:

the revenue stamp (24) is formed as a rectangular blank and is attached to the outer wrapping (11) adjacent an upright first side wall (14), the first side wall being formed opposite a second side wall (15) comprised of connected wall flaps (16, 17);

the tear strip (22) is arranged transverse to the first side wall (14) and transverse to the revenue stamp (24) in such a way that the revenue stamp (24) extends above and below the tear strip (22); and the revenue stamp (24) is connected to the outer wrapping (11) at both sides of the tear strip, by glue spots (25, 26).

* * * * *